US005905422A

United States Patent [19]

Doneghue

[11] Patent Number: 5,905,422

[45] Date of Patent: May 18, 1999

[54] RELAY ADJUSTMENT STRUCTURE

[75] Inventor: Jeffrey A. Doneghue, Lawrenceville, Ill.

[73] Assignee: Siemens Electromechanical Components, Inc.

[21] Appl. No.: 08/756,667

[22] Filed: Nov. 26, 1996

[51] Int. Cl.[6] ..... H01H 51/22

[52] U.S. Cl. ..... 335/78; 335/128; 335/80; 335/86; 335/273; 335/279

[58] Field of Search ..... 335/78–86, 273, 335/279, 281, 128

[56] References Cited

U.S. PATENT DOCUMENTS

| | | | |
|---|---|---|---|
| 3,940,724 | 2/1976 | Cleary et al. | 335/197 |
| 3,964,007 | 6/1976 | Hayden | 335/187 |
| 4,193,052 | 3/1980 | Hayden | 335/128 |
| 4,476,451 | 10/1984 | Kosugi | 335/262 |
| 5,289,144 | 2/1994 | Liao | 335/78 |
| 5,434,475 | 7/1995 | Walters et al. | 335/159 |
| 5,627,503 | 5/1997 | Mader | 335/78 |

*Primary Examiner*—Michael L. Gellner
*Assistant Examiner*—Tuyen T. Nguyen
*Attorney, Agent, or Firm*—Donald B. Paschburg

[57] ABSTRACT

There is provided structure for use in adjusting certain design parameters of a relay during initial assembly of the relay. The structure includes an adjustment member insertable between a bobbin and a core. The adjustment member is preferably U-shaped having arms straddling the core and a backspan which acts as a stop to define the travel of an armature. The adjustment member is driven between the bobbin and core and permanently fixed in place when the desired parameters have been attained. The armature is forced against the motor assembly until the desired design parameters are obtained and the motor assembly is then permanently fixed in place within the relay. An armature is forced against the core moving it within the bore of the bobbin until the desired parameters have been obtained. Thereafter, the core is permanently fixed in position within the bore of the bobbin.

13 Claims, 4 Drawing Sheets

RELAY ADJUSTMENT STRUCTURE

BACKGROUND OF THE INVENTION

1. Field of the Invention

The present invention relates to relay adjustments and methods and, more particularly, to structure and methods for adjustment of relay operational design parameters during assembly.

2. Background of Related Art

In the production and assembly of relays, various design parameters must be taken into account to ensure proper operation. These parameters include the orientation of various relay components which must be precisely established. Relays generally include a movable contact and one or more stationary contacts. A magnetic motor assembly is provided to move the movable contact into and out of engagement with the stationary contacts. The magnetic motor assembly has an electromagnet including a magnetic core and a bobbin with windings surrounding the bobbin. An armature is provided and is mounted for movement with respect to the motor assembly. The armature is linked with the movable contact, usually by a bridge, to move the movable contact upon energizing the electromagnet.

In order for a relay to function as smoothly and quietly as possible, it is necessary that certain operational design parameters be established and maintained. For example, the distance between the movable contact and the stationary contact, i.e. the contact gap, as well as the load placed on the stationary contact by the movable contact, i.e. the overtravel, must be set and maintained within precise limits. Similarly, the distance through which the armature moves to contact the electromagnet, i.e. the armature gap, must also be precisely established. Each of these design parameters is interrelated due to the movement of the various components. Upon assembly of the components, variations in manufacturing tolerances may also inhibit the establishment of precise design parameters.

Thus, it wold be desirable to have structure and methods for allowing the positions of the various components of a relay to be adjusted during assembly to attain the desired design parameters.

SUMMARY OF THE INVENTION

The disclosed relay incorporates various structure and utilize various methods for adjusting certain operational design parameters of the relay during initial assembly of the relay to compensate for various tolerances due to manufacturing, etc. The disclosed relay generally includes a base having one or more stationary contacts mounted to the base. Preferably, there are two stationary contacts mounted to the base. A movable contact is mounted to the base intermediate the stationary contacts. The movable contact is generally movable between a position engaging at least one of the stationary contacts and a position spaced apart from that stationary contact. In order to move the movable contact there is provided a motor assembly which includes a bobbin with a plurality of windings surrounding the bobbin and a core disposed within a bore of the bobbin. An armature is provided and is mounted for movement with respect to the base and the motor assembly. A bridge extends between a free end of the armature and the movable contact. In one embodiment of the disclosed invention, adjustment structure in the form of an adjustment member is provided and is insertable between the bobbin and the core. Preferably, the adjustment member is U-shaped having a pair of arms straddling the core to align the adjustment member on the core. The adjustment member also includes a backspan which acts as a stop to define the travel of the armature.

A method of initially adjusting the relay includes inserting the U-shaped adjustment member between the bobbin and the core and moving the armature into engagement with the backspan to force the adjustment member between the bobbin and core. The adjustment member is preferably permanently fixed in place when the desired operational design parameters have been attained.

An alternative embodiment does not include an adjustment member but, rather, includes a bobbin and core which are mounted for movement with respect to the base. Specifically, the bobbin and core may pivot about a point on the base. The method of adjusting the relay includes forcing the armature against the motor assembly to pivot the motor assembly until desired design parameters are obtained at which point the motor assembly including the bobbin and core is then permanently fixed in place within the relay.

An additional embodiment of the disclosed relay includes providing a bobbin which is fixed with respect to the base and has a slightly enlarged bore such that the core is movable within the bore of the bobbin. The armature is forced against a portion of the core, moving the core within the bore of the bobbin until desired operational design parameters have been obtained. Thereafter, the core can be permanently fixed within the bore of the bobbin. In one embodiment the core slides transversely with respect to a longitudinal axis of the bore of the bobbin. In an alternative embodiment the bore is tapered and the core pivots about a pivot point at one end of the bobbin bore. The bore of the bobbin may also be tapered such that the diameters of the ends of the bore are greater than the diameter at a point intermediate the ends of the bore to define a waist about which the core may pivot.

BRIEF DESCRIPTION OF THE DRAWINGS

Preferred embodiments of the invention are described hereinbelow with reference to the drawings wherein.

DETAILED DESCRIPTION OF PREFERRED EMBODIMENTS

Figure 1:
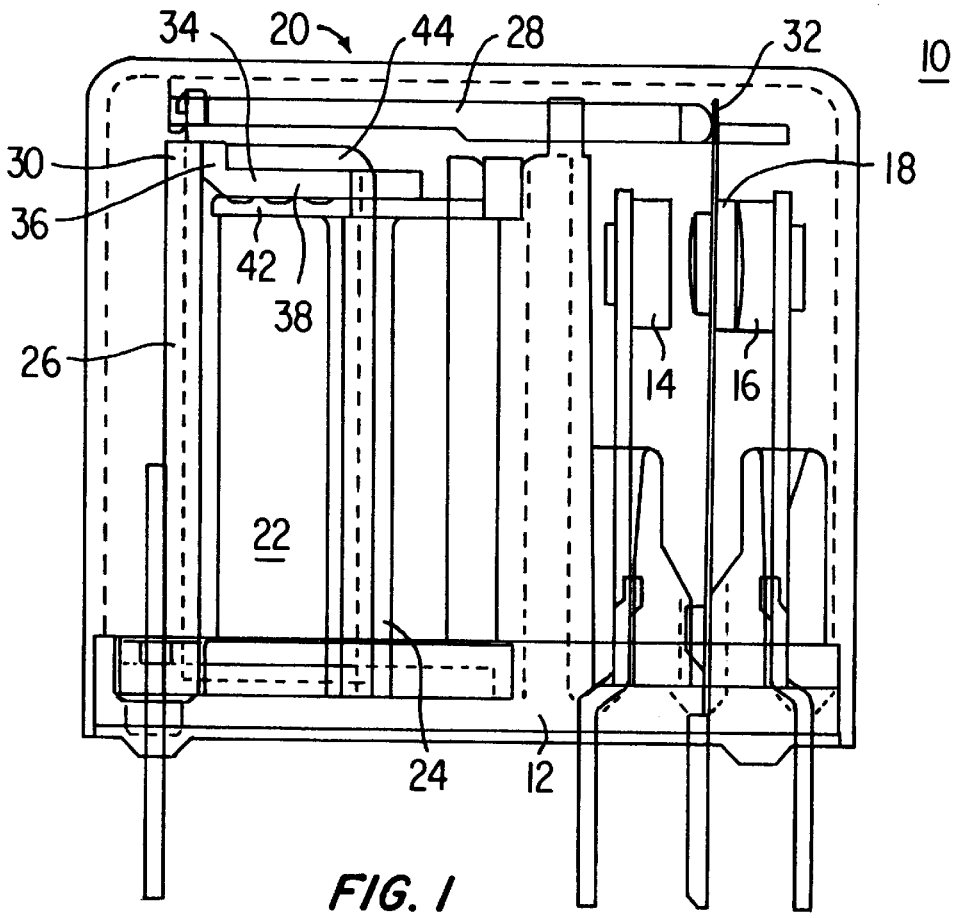
FIG. 1 is a side view in cross-section of a first embodiment of a relay incorporating a movable adjustment member.

Referring to FIG. 1, there is shown a relay 10 in accordance with the present invention. Relay 10 is configured to allow adjustment of design parameters, such as contact gap, overtravel and armature gap during assembly. Relay 10 includes a base 12 and first and second stationary contacts, 14 and 16 respectively, mounted to base 12. A movable contact 18 is positioned between first and second stationary contacts 14 and 16, and is also mounted to base 12. Movable contact 18 is movable between a first position (not shown) engaging first stationary contact 14 and spaced from second stationary contact 16 to a second position engaging second stationary contact 16 and spaced from first stationary contact 14.

A motor assembly 20 is provided to move movable contact 18 between the first and second positions. Motor assembly 20 includes a bobbin 22 having a core 24 positioned therein and an armature 26. Bobbin 22 and core 24 are fixed with respect to base 12. While not specifically shown, bobbin 22 typically includes a plurality of windings thereround as is known to those skilled in the art. Armature 26 has a first end 30 which is movable toward and away from bobbin 22. A bridge 28 extends between first end 30 of armature 26 and a free end 32 of movable contact 18.

Figure 2:
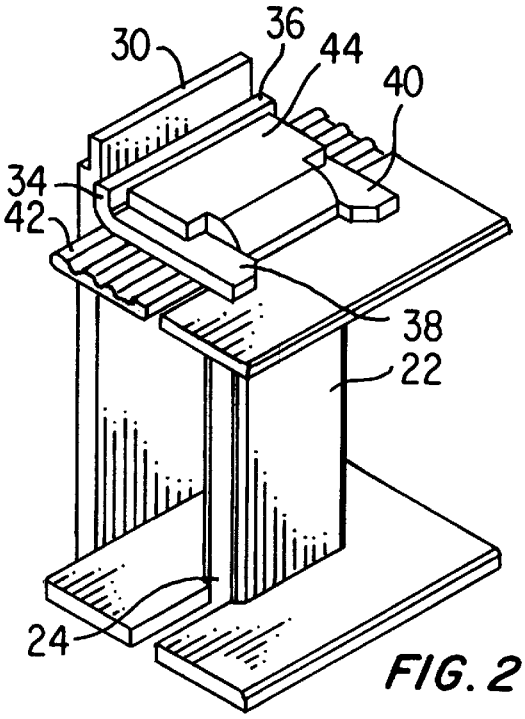
FIG. 2 is a simplified perspective view, showing an armature, a bobbin, a core, and a movable adjustment member of FIG. 1.
Figure 3:
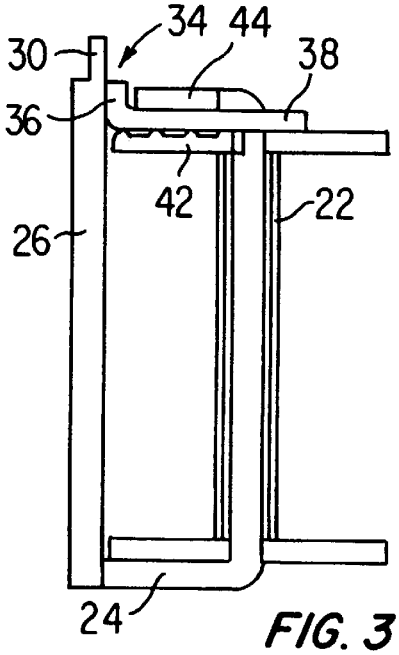
FIG. 3 is a side view of the structure shown in FIG. 2.

Referring now to FIGS. 1–3, in order to provide adjustment of design parameters such as, contact gap, overtravel, and armature gap during assembly of relay 10, there is provided a generally U-shaped adjustment member 34. Adjustment member 34 has an upwardly projecting backspan 36 and a pair of arms 38 and 40 extending from backspan 36.

As best seen in FIG. 3, adjustment member 34 is positioned above the flange 42 of bobbin 22 and between flange 42 and an extension 44 of core 24. Arms 38 and 40 straddle core 24. Backspan 36 of adjustment member 34 is oriented facing first end 30 of armature 26 and is engageable therewith.

Referring now to FIGS. 1 and 3, during assembly of relay 10, adjustment member 34 is inserted between flange 42 and extension 44, and is held therebetween in friction fit fashion. Armature 26 is moved to establish the correct contact gap and degree of overtravel by forcing bridge 28 against free-end 32 of movable contact 18. As armature 26 is adjusted, first end 30 engages backspan 36 of adjustment member 34, forcing adjustment member 34 between flange 42 of bobbin 22 and extension 44 of core 24. The precise position of adjustment member 34 is maintained upon release of armature 26 due to the friction fit. Once the desired contact gap and degree of overtravel have been attained, adjustment member 34 may be permanently fixed to either core 24 or bobbin 22 in known manner, such as, for example, by glues, epoxies, welding, staking, etc.

Figure 4:
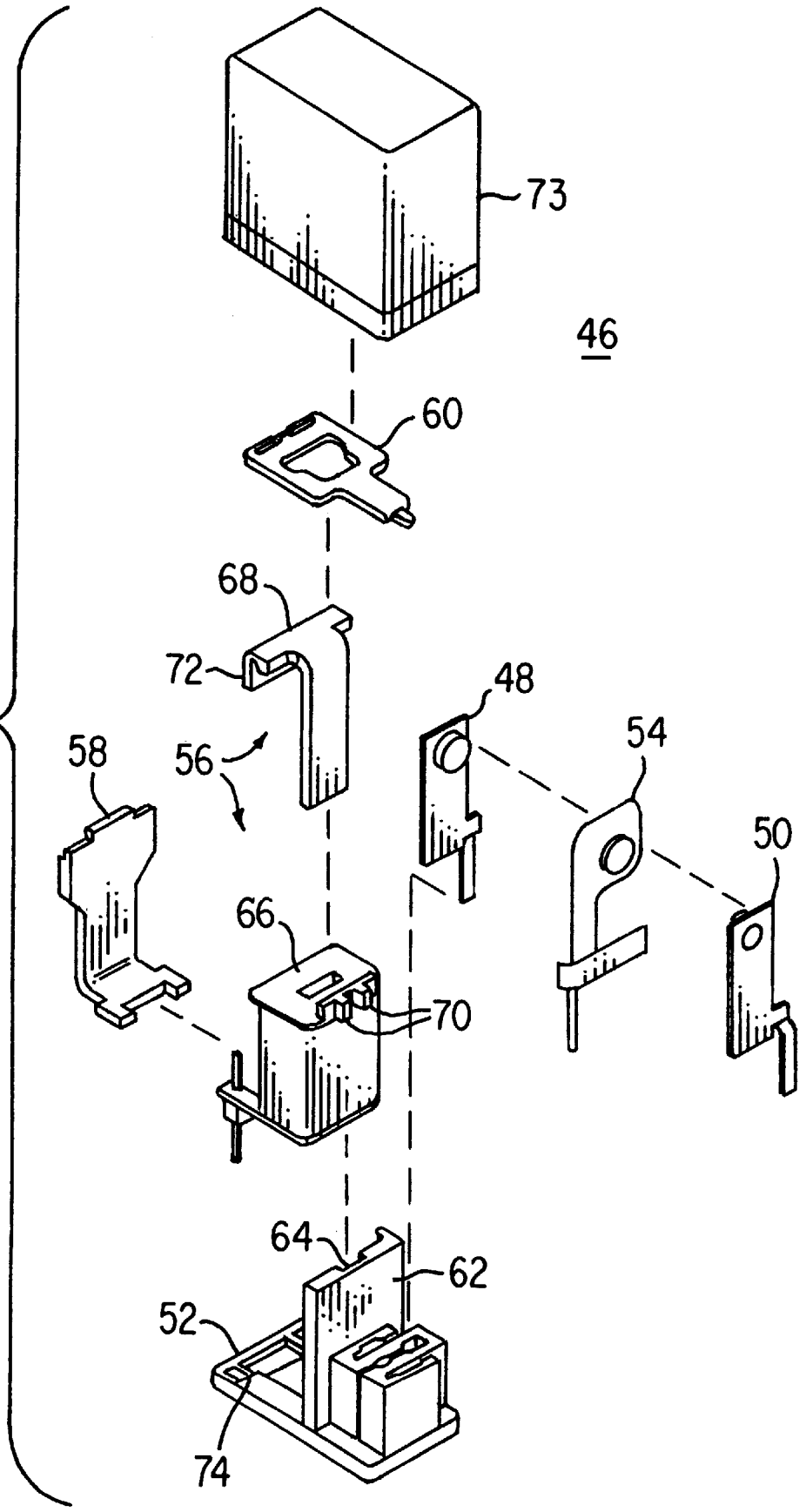
FIG. 4 is a view with parts separated of another embodiment of a relay having a movable motor assembly and capable of adjustment during assembly.
Figure 4A:
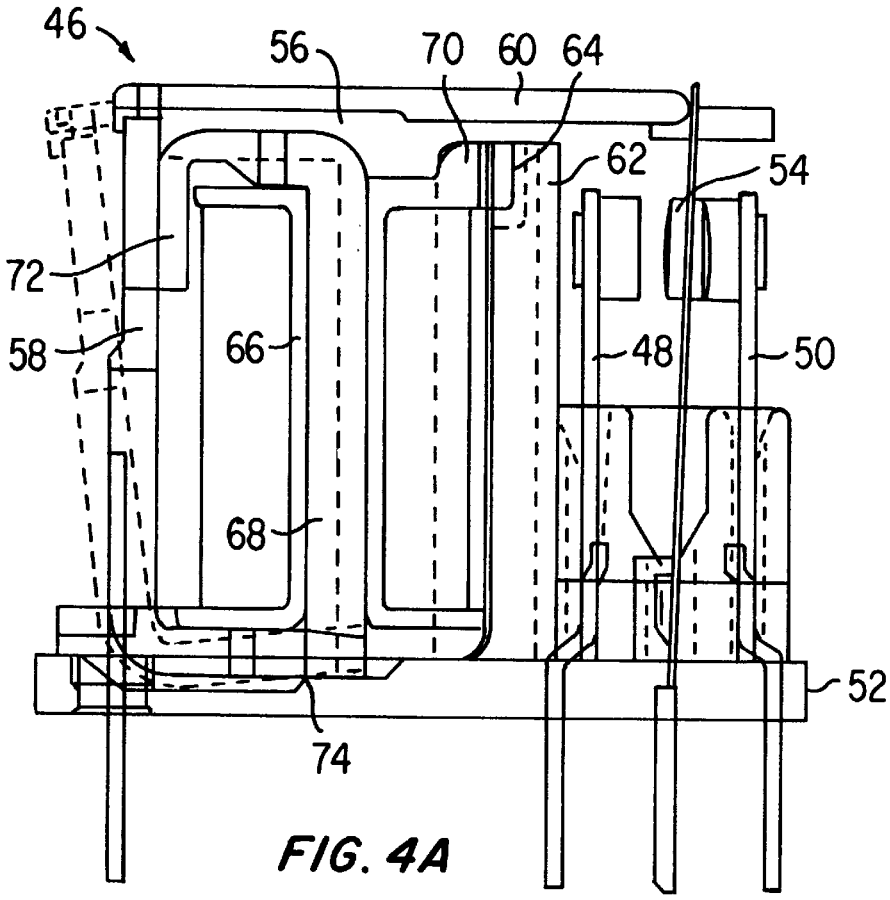
FIG. 4A is a side view in cross-section of the embodiment of FIG. 4.

Referring now to FIGS. 4 and 4A, there is shown an alternate relay 46 and method of adjusting same during assembly. Relay 46 is similar to relay 10 above and generally includes a pair of stationary contacts 48 and 50 affixed to a base 52 and a movable contact 54 also affixed to base 52. A motor assembly 56 as well as an armature 58 and a bridge 60 are provided to move movable contact 54 between stationary contacts 48 and 50. A frame portion 62 extends from base 52 and has a gap or nest 64 for frictional receipt of a portion of motor assembly 56.

Motor assembly 56 includes a bobbin 66 and a core 68 which is fixed relative to bobbin 66. Bobbin 66 is initially free to move relative to base 52 and frame portion 62. Bobbin 66 includes a projections 70 configured to frictionally engage nest 64. Core 68 includes a core head 72 engageable with armature 58. A cover 73 is provided to engage base 52 after adjustment and assembly.

In initially assembling and adjusting relay 46, armature 58 is rotated until it contacts core head 72. Once armature 58 contacts core head 72, further pressure on armature 58 rotates motor assembly 56, i.e., bobbin 66 and core 68, about a pivot point or step 74 formed in base 52. As motor assembly 56 and armature 58 are rotated, bridge 60 engages and moves movable contact 54. Projection 70 of bobbin 66 frictionally engages nest 64 in frame portion 62 to hold motor assembly 56 in position upon establishment of the correct contact gap and overtravel.

Thereafter bobbin 66 may be permanently affixed to base 52 and frame portion 62 in a manner similar to that described above with respect to adjustment member 34 of relay 10.

Figure 5:
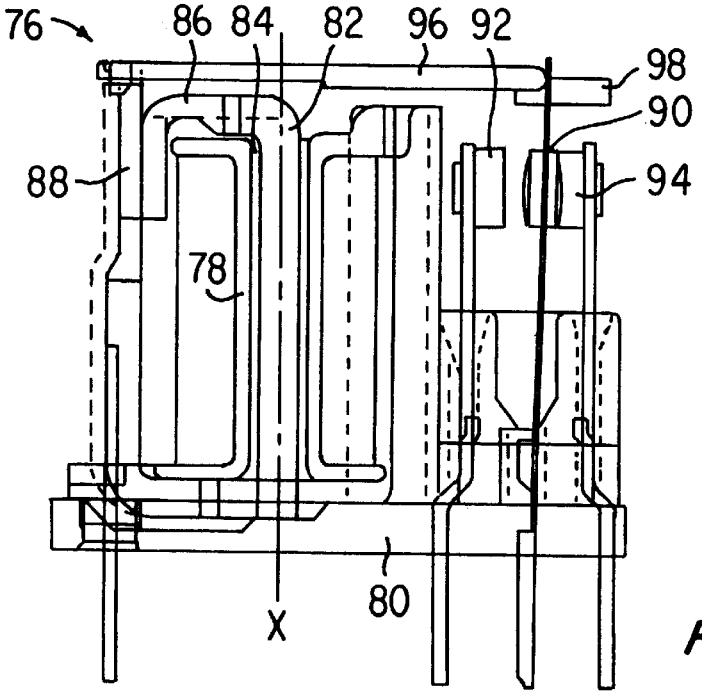
FIG. 5 is a side view in cross-section of a further embodiment of a relay having a movable core and capable of adjustment during assembly.

Referring now to FIG. 5, there is shown another embodiment of the present invention. Relay 76 is provided with a bobbin 78 that remains in a fixed position and is affixed to a base 80. A core 82 is press fit within a bore 84 of bobbin 78. Bore 84 is of substantially uniform cross-section. Core 82 is configured to slide within bore 84 in a direction substantially transverse to a longitudinal axis X of bore 84. Core 82 includes a core head 86 engageable with an armature 88. Relay 76 also includes a movable contact 90 and a pair of stationary contacts 92, 94, mounted on base 80.

Upon assembling relay 76, armature 88 is forced into contact with core head 86. Armature 88 and core head 86 are moved together to cause an end 98 of bridge 96 to move movable contact 90 into the desired position. Movement of core head 86 slides core 82 transversely within bore 84 of bobbin 78. Once movable contact 90 has been properly positioned and the desired contact gap and overtravel has been established, core 82 may be permanently fixed within bore 84 of bobbin 78.

Figure 6:
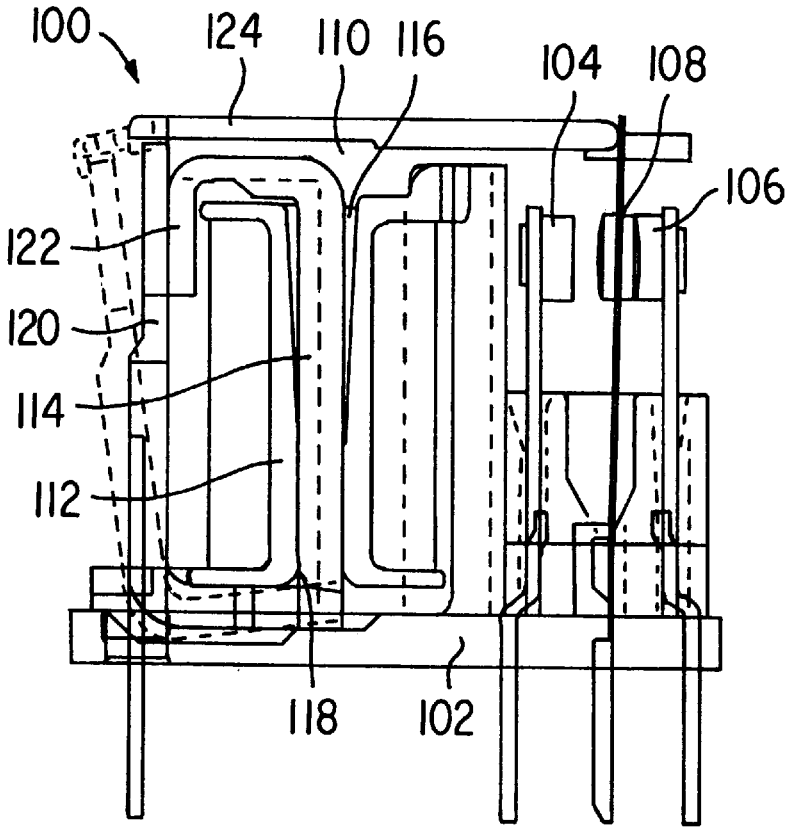
FIG. 6,is a side view in cross-section of a further embodiment of a relay having a movable core and capable of adjustment during assembly.

Turning now to FIG. 6, there is shown another embodiment of a relay in accordance with the present invention in which the bobbin is assembled in a fixed position with respect to the base and is not free to move during assembly and adjustment. Relay 100 has a base 102 and a pair of stationary contacts 104, 106 fixed to base 102. A movable contact 108 is positioned between stationary contacts 104, 106 and fixed to base 102. Relay 100 also includes a motor assembly 110 having a bobbin 112 which, as noted above, is fixed in position with respect to base 102 and a core 114. Bobbin 112 has a tapered bore 116 into which core 114 is positioned. By moving core 114 within tapered bore 116, core 114 pivots about a point 118 at the base of tapered bore 116. Relay 100 also includes an armature 120 engageable with a core head 122 formed on core 114. A bridge 124 extends from armature 120 and engages movable contact 108.

In order to adjust relay 100 to obtain the desired contact gap and degree of overtravel, armature 120 is initially moved into contact with core head 122. Further movement of armature 120 causes core 114 to pivot about point 118 within tapered bore 116. As armature 120 is moved, bridge 124 also moves and causes movable contact 108 to move into engagement with stationary contact 106 to obtain the desired amount of contact gap and overtravel. Core 114 may then be permanently fixed in its position within tapered bore 116 of bobbin 112.

Figure 7:
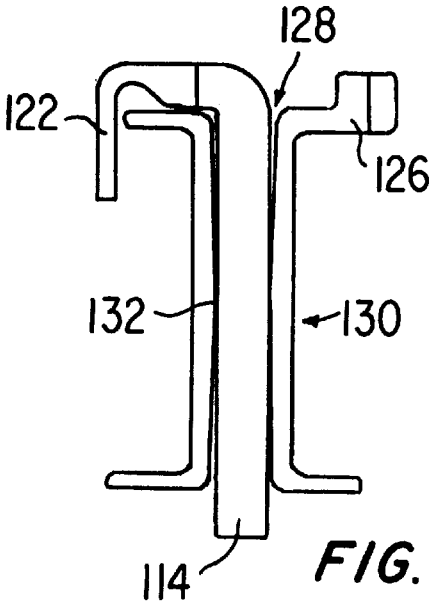
FIG. 7 is a side view of alternate core-bobbin structure used with the relay of FIG. 6.

Referring for the moment to FIG. 7, there is illustrated an alternative bobbin 126 for use with relay 100. Bobbin 126 has a double tapered bore 128, that is, a bore which tapers from larger diameters at its end to a smaller diameter or waist 130 intermediate the ends. Waist 130 defines a pivot point 132 about which core 114 can pivot during initial adjustment of relay 100.

It will be understood that various modifications can be made to the embodiments of the present invention disclosed herein without departing from the scope and spirit thereof. For example, various locations for establishing a pivot point between the bobbin and core may be provided where the bobbin is fixed. Additionally, where the entire motor assembly is moved, the motor assembly may be pivoted about various locations as well as being slid toward and away from the contacts. Therefore, the above description should not be construed as limiting, but merely as exemplifications of preferred embodiments thereof. Those skilled in the art will envision other modifications within the scope and spirit of the present invention as defined by the claims appended hereto.

What is claimed is:

1. A relay comprising:

at least one stationary contact mounted on a base and a movable contact mounted on the base, the movable contact movable with respect to the at least one stationary contact;

an armature mounted for movement on the base;

a bridge positioned between the armature and the movable contact, the bridge being positioned to transfer movement of the armature to the movable contact;

a motor assembly fixedly mounted to the base; and an adjustment member mounted on the motor assembly and engageable with the armature assembly, wherein the adjustment member is formed with a backspan engageable with the armature, the adjustment member being configured to move in relation to the motor assembly prior to complete assembly of the relay to allow for adjustment of design parameters of the relay.

2. The relay as recited in claim 1, wherein the motor assembly includes a bobbin and a core, and the adjustment member is slidably positioned between the bobbin and core prior to complete assembly of the relay.

3. The relay as recited in claim 2, wherein the adjustment member includes a pair of arms which straddle the core, the arms being movable about the core prior to complete assembly of the relay.

4. The relay as recited in claim 2, wherein the adjustment member is frictionally held between the bobbin and the core prior to complete assembly of the relay.

5. A relay comprising:

at least one stationary contact mounted on a base and a movable contact mounted on the base, the movable contact engageable with the stationary contact;

an armature mounted for movement on the base;

a bridge positioned between the armature and the movable contact, the bridge being positioned to transfer movement of the armature to the movable contact; and a motor assembly positioned on the base and engageable with the armature, wherein the motor assembly is formed with a backspan engageable with the armature, the base and the motor assembly being configured to permit the motor assembly to pivot in relation to the base prior to complete assembly of the relay to allow for adjustment of design parameters of the relay.

6. The relay as recited in claim 5, wherein the motor assembly pivots about a step formed in the base.

7. The relay as recited in claim 6, wherein the motor assembly is pivoted about the step on the base prior to complete assembly of the relay by engagement with the armature.

8. The relay as recited in claim 5, wherein the motor assembly has a bobbin fixed with respect to the base and a core movable with respect to the bobbin, the core being engageable with the armature.

9. The relay as recited in claim 8, wherein the core is mounted for movement within a bore of the bobbin.

10. The relay as recited in claim 9, wherein the core is slidable transversely with respect to a longitudinal axis of the bore of the bobbin.

11. The relay as recited in claim 9, wherein the core is mounted for pivotal movement with respect to the bore of the bobbin.

12. The relay as recited in claim 11, wherein the core pivots about a pivot point located at one end of the bore of the bobbin.

13. The relay as recited in claim 12, wherein the core pivots about a waist defined between ends of the bore of the bobbin.

* * * * *